US008100604B1

(12) United States Patent
Flasher

(10) Patent No.: US 8,100,604 B1
(45) Date of Patent: Jan. 24, 2012

(54) PASSIVE CAPILLARY WICKING DEVICE

(75) Inventor: Gary L. Flasher, Spring City, PA (US)

(73) Assignee: Davlyn Manufacturing Company, Inc., Spring City, PA (US)

( * ) Notice: Subject to any disclaimer, the term of this patent is extended or adjusted under 35 U.S.C. 154(b) by 108 days.

(21) Appl. No.: 12/462,953

(22) Filed: Aug. 12, 2009

Related U.S. Application Data

(60) Provisional application No. 61/088,211, filed on Aug. 12, 2008.

(51) Int. Cl.
*E02B 11/00* (2006.01)

(52) U.S. Cl. ..... 405/50; 405/43; 405/36

(58) Field of Classification Search ..... 405/36, 405/43, 44, 45, 50, 302.7, 302.4
See application file for complete search history.

(56) References Cited

U.S. PATENT DOCUMENTS

| | | | | |
|---|---|---|---|---|
| 3,578,764 | A | 5/1971 | Nunnally et al. | |
| 3,910,753 | A * | 10/1975 | Lee | 431/290 |
| 4,752,402 | A * | 6/1988 | Gray | 405/43 |
| 4,931,326 | A | 6/1990 | Weil | |
| 4,979,280 | A | 12/1990 | Weil | |
| 4,986,033 | A | 1/1991 | Weil | |
| 5,066,028 | A | 11/1991 | Weil | |
| 5,082,297 | A | 1/1992 | Flasher | |
| 5,107,623 | A | 4/1992 | Weil | |
| 5,552,048 | A * | 9/1996 | Miller et al. | 210/489 |
| 5,614,282 | A | 3/1997 | Bono, Jr. et al. | |
| 5,617,900 | A | 4/1997 | Weil | |
| 5,866,216 | A | 2/1999 | Flasher | |
| 5,977,429 | A * | 11/1999 | Phillips et al. | 604/370 |
| 6,152,653 | A * | 11/2000 | Henry et al. | 405/129.7 |
| 6,505,996 | B1 * | 1/2003 | Ianniello et al. | 405/43 |
| 7,025,359 | B2 | 4/2006 | Flasher | |
| 7,104,546 | B2 | 9/2006 | Bono, Jr. | |
| 7,874,767 | B2 * | 1/2011 | Jones et al. | 405/302.7 |
| 2002/0044842 | A1 * | 4/2002 | Ianniello et al. | 405/302.7 |
| 2003/0213181 | A1 | 11/2003 | Weil | |
| 2004/0026874 | A1 | 2/2004 | Flasher | |
| 2004/0094905 | A1 | 5/2004 | Weil | |

OTHER PUBLICATIONS

Superintendents' Korner. OSU Innovation: Passive Capillary Drainage of Turf Soil Profiles. Dr. Ed McCoy. Undated,. 2 pages. (www.turftechnow.com).

TurfTech™. Retrieved Aug. 2009. www.turftechnow.com. Home of webpage. 4 pages.

TurfTech™. Retrieved Aug. 2009. www.turftechnow.com. Brochure for Golf, Sports Turf, 2 pages. http://www.turftechnow.com/Brochure%20Revised%2007292007a.pdf.

TurfTech™. Retrieved Aug. 2009. www.turftechnow.com. Installation instructions, 1 page. http://www.turftechnow.com/Installation%20Overview%20Page.pdf.

TurfTech™. Retrieved Aug. 2009. www.turftechnow.com. Installation instructions, for planters 2 pages. http://www.turftechnow.com/TTN%20FloWick%20for%20Plantere%20Lit.pdf.

* cited by examiner

*Primary Examiner* — Frederick L Lagman
(74) *Attorney, Agent, or Firm* — Panitch Schwarze Belisario & Nadel LLP

(57) ABSTRACT

A wicking device is an elongated tubular assembly having opposing ends and formed of an elongated, porous, tubular, heat resistant, metallic core suggestedly of interwoven resilient wire, a wicking layer of glass fiber yarns extending generally longitudinally along the outer surface of the metallic core, at least substantially surrounding the metallic core, and an exterior of interwoven glass fiber yarns forming an elongated tubular outer jacket running the length of the device surrounding the wicking layer of glass fiber yarns and the metallic core. The assembly is stripped of organic materials following assembly as part of the manufacturing process, preferably by heating the assembly.

18 Claims, 3 Drawing Sheets

PASSIVE CAPILLARY WICKING DEVICE

BACKGROUND OF THE INVENTION

The present invention relates to a wicking device to be buried in the ground to transfer excess water and water based fluids. One previously known type of passive capillary wicking devices had a glass fiber yarn exterior surrounding an inner layer of glass fiber wicking yarns, which surrounded an innermost, porous tubular thermoplastic core. The thermoplastic core of wicking devices provides a passageway within the center of the wicking yarns to carry away excess fluid entering the device in amounts and at rates greater than the exterior and wicking yarns can carry away themselves. It has been determined this passageway noticeably improves the wicking capacity of the yarns. The glass fibers yarn exteriors are generally used to prevent environmental degradation of the wicking device.

BRIEF SUMMARY OF THE INVENTION

A wicking device of the present invention comprises in a tubular assembly: an elongated, porous, tubular, heat resistant, metallic core; a wicking layer of glass fiber yarns extending generally longitudinally along an outer surface of the metallic core, at least substantially surrounding the metallic core 16, the threads for the yarns being continuous along the length of the device); and an exterior of interwoven glass fiber yarns forming an elongated tubular outer jacket running the length of the device surrounding the wicking layer of glass fiber yarns and the metallic core.

The invention further includes a method of making the wicking device as an assembly comprising the steps of: surrounding the metallic core with the wicking layer of glass fiber yarns extending generally longitudinally along the outer surface of the metallic core, at least substantially surrounding the metallic core; interweaving an outer jacket of glass fiber yarns surrounding the metallic core and the wicking layer of glass fiber yarns to form the tubular assembly; and stripping the tubular assembly of any organic matter as part of manufacture.

The invention further includes a method of using the wicking device comprising the steps of: locating a first continuous length of the wicking device beneath a surface of soil; and locating one end of the first continuous length of the wicking device below a remainder of the first continuous length of the wicking device to drain the wicking device.

DETAILED DESCRIPTION OF THE INVENTION

Figure 1:
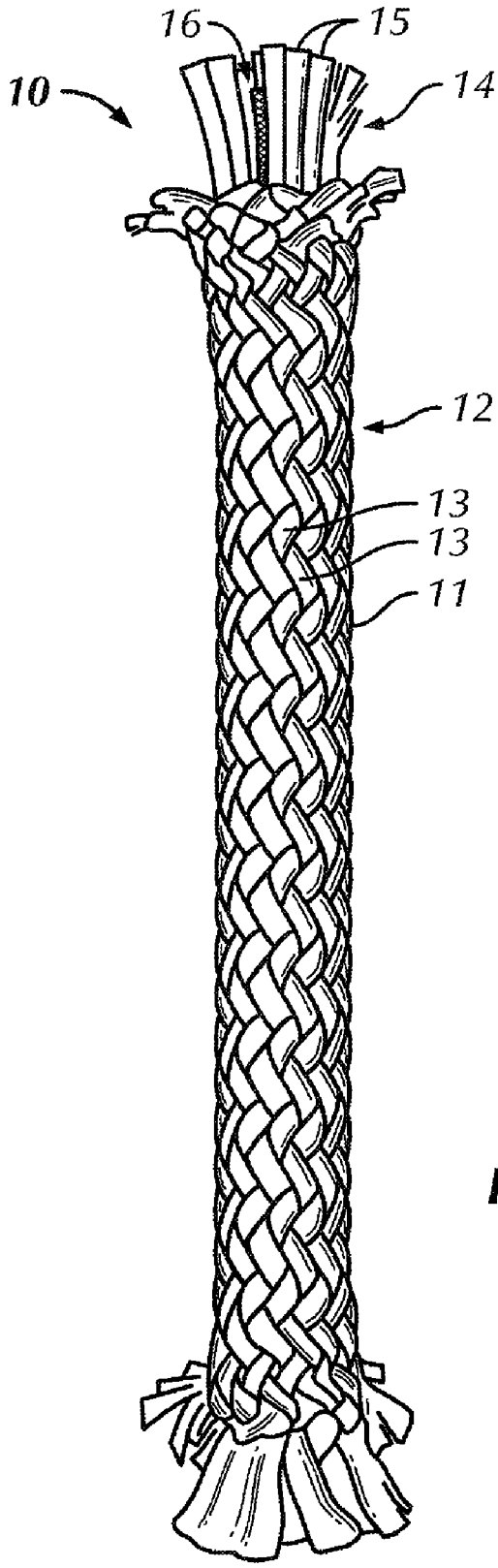
FIG. 1 depicts a short length of a first embodiment of the wicking device.
Figure 2:
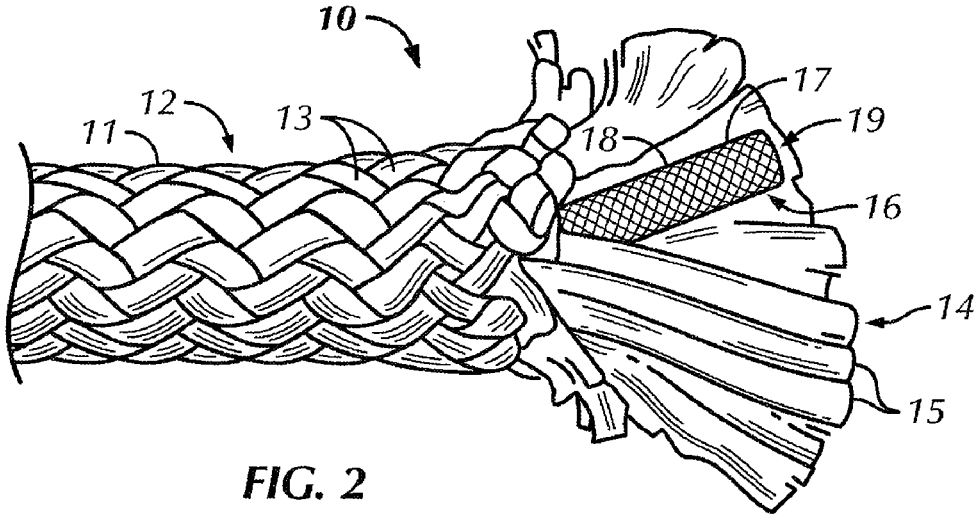
FIG. 2 depicts a close-up view of one end of the first embodiment of FIG. 1 showing the interwoven wire core of the wicking device.
Figure 3:
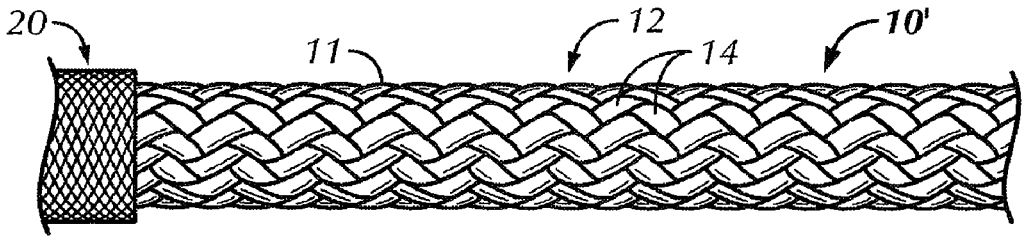
FIG. 3 depicts a second embodiment of the wicking device, which is based upon the first embodiment wicking device of FIGS. 1-2.

FIGS. 1-3 depict the first embodiment of the wicking device of the present invention indicated generally at 10. Wicking device 10 (FIG. 1) is a tubular assembly having three main components: an elongated, porous, tubular, heat resistant, metallic core 16; a wicking layer 14 of glass fiber yarns 15 extending generally longitudinally along the outer surface 18 of the metallic core 16, surrounding the metallic core 16; and an exterior 11 of interwoven glass fiber yarns 13 forming an elongated tubular outer jacket 12 (FIG. 5), also running the length of the device 10 surrounding the wicking layer 14 glass fiber yarns 15 and the metallic core 16. Only a partial length of a wicking device is shown in FIGS. 1-3. Wicking devices of the present invention are preferably fabricated in continuous lengths of tens to hundreds of feet and are cut to shorter lengths for use. They can also be provided in predetermined lengths, suggestedly no greater than one hundred feet, and lengths of about ninety feet or less are suggested.

As best shown in FIG. 2, the wicking device 10 is constructed so that the interwoven glass fiber yarn exterior 12, the longitudinally extending wicking yarns 14, and the elongated, tubular porous metallic core 16 are at least generally coaxial. The interwoven glass fiber yarns 13 forming the exterior 11 serve to contain and protect the wicking yarns 15. Glass fiber yarns are chosen because of their hydroscopic characteristics, being both highly permeable and absorptive, and because of their ability to withstand environmental degradation. The glass fiber yarns 13 of the tubular outer jacket 12 forming the exterior 11 of the device 10 may be knitted or braided, a warp knit being depicted.

The wicking yarns 14 provide the majority of the wicking capability. It is believed there is a capillary attraction between the glass fiber yarns and water or water based liquids. To that end, it is important that the wicking layer 14 be at least essentially continuous (i.e. without gaps in the longitudinal direction) along the length of the device, at least for normal suggested uses. The wicking layer 14 may be provided by lengths of glass fiber yarns 15 extending generally longitudinally along an outer surface of the metallic core 16 such that the wicking layer at least essentially surrounds the metallic core along essentially the length of the device 10. Individual yarns 15 shorter than the entire length of the device 10 may be used as long as the longitudinally adjoining ends of adjoining lengths of yarns 15 are overlapped or butted sufficiently closely to maintain a capillary connection along their length. For the wicking devices described herein, the wicking layer 14 can be formed, for example, from twenty four ends (spools) of ETG 1.4 textured yarns while the outer jacket 16 can be formed from twelve ends of ETG 2.7 textured yarns interwoven over the wicking layer 14 and core 16.

It has further been determined that the overall flow through the wicking device 10 is increased significantly where an open passageway 19 is provided through the center of the wicking yarns 15. The porous metallic core 16 is located at the center of the wicking device 10 and the wicking yarns 15, at least generally coaxially with the outer jacket 12 of interwoven glass fiber yarns 13 and wicking yarns 15 of the wicking layer 14. As best seen in FIG. 2, the core 16 is suggestedly constructed of resilient metallic wire 17 preferably knitted into a plurality of interlocking loops. The core 16 is suggestedly formed of knitted stainless steel wire to resist environmental damage, suggestedly five to twelve mils thick, and is at least partially hardened (i.e. tensile strength of at least 150,00 psi), preferably fully hardened (i.e. about 300,000 psi or more), for resilience to the core 16 to resist collapsing. The core 16 is suggestedly constructed in a continuous jersey knit, for example, one having approximately eight wales/inch and eight to twelve courses/inch to form a continuous knit, cylindrically-shaped, hollow tube approximately one quarter of an inch in inner diameter. The specification for a wire knitting machine to knit the interwoven wire core 16 may be seven-eights inch cylinder, eight needles, eighteen gauge, circular jersey knitting machine. Larger diameters can be made in a similar way. Sizes up to about one-half inch in inner diameter are envisioned for the various uses hereinafter described. In any case, the interlocking loops are arranged such that they form a hollow mesh cylindrical tube shape. The core 16 serves to create a passageway 19 within the wicking yarns 14 to carry away excess amounts of water passing through the wicking yarns 14. Alternatively, the core 16 can be provided by metal wires interwoven in a braid.

The normal manufacturing process of glass fiber yarns results in a coating on the fibers that is generally referred to as a binder. The binder is typically made of starch and oil and has a tendency to repel water as well as other fluids. Because a desired effect of the wicking device is to draw water away from an area, the binder's tendency to repel water reduces the desired effect of the wicking device. Over time, this binder will be washed away by liquid passing through or along the yarn but removal is a gradual process so the full drainage capacity of the prior art devices was not achieved until after months or years of use.

It has been found that possible to eliminate the starch-oil binder from the glass fibers which, in turn, greatly improves the wicking capacity of the wicking device in initial operation. However, in order to quickly and completely remove the binder, it has been found necessary to heat-treat the wicking devices, in particular, heating the devices to temperatures of 300° F. or more. These temperature are greater than the melting point of the thermoplastic core used in the prior art devices. As a result, heat-treatment to eliminate the glass fiber binding would have resulted in the destruction of the thermoplastic core used in the prior art. Because the melting point of the interwoven wire core 16 is hundred of degrees greater than the decomposition temperature of the binder of the glass fiber yarns and any other organic material which the glass fiber or the core wire might be treated or contaminated, it is now possible to heat-treat the glass fiber yarns quickly after assembly of the device 10 to remove the binder and any other organic material on or in the device 10, during manufacture, while maintaining an open passageway 19 within the wicking layer 14 of yarns 15. This treatment results in a fully functional wicking device with a significant increase to the immediate wicking capacity of the wicking device 10 as compared to the newly manufactured devices of the prior art.

The method of making the wicking device 10 is straight forward. The assembly is formed by surrounding the metallic core 16 with the wicking layer 14 of glass fiber yarns 15 extending generally longitudinally along the outer surface 18 of the metallic core 16, at least substantially surrounding the metallic core 16 and preferably completely surrounding the core 16, and interweaving the outer jacket 12 of glass fiber yarns 13 surrounding the metallic core 16 and the wicking layer 14 of glass fiber yarns 15 to form the tubular assembly. The tubular assembly is thereafter heated sufficiently to remove the binder and any other organic matter that might be present on the wire 17 or the yarns 13, 15. Preferably, the assembly is heated to a temperature of at least 300° F. To do so, the assembly is passed through an oven about eight feet in length maintained at a temperature above 300° F. using infrared heaters (for example, about 700° F.) at a rate of about two hundred and fifty feet per hour, which has been found sufficient for all of the yarn to be raised to a temperature sufficient to vaporize or oxidize all organic material on the yarns, suggestedly a temperature of about 300° F. or more. The glass fiber yarns 15, 13 of the wicking layer 14 and the tubular outer jacket 12 are thus stripped of any known hydrophobic coating. The wicking device 10 remaining after the heating process consists essentially of the elongated, porous, tubular, heat resistant, metallic core 16, the wicking layer 14 of glass fiber yarns 15, and the exterior 11 of interwoven glass fiber yarns 13 forming the elongated tubular outer jacket 12.

FIG. 3 partially illustrates a slightly modified version of the wicking device 10, indicated generally at 10'. Wicking device 10' is wicking device 10 provided with a resilient porous metallic outer jacket 20, preferably again made of interwoven metal wire, at least partially and preferably fully hardened to provide even greater resiliency to the device 10'. Such jacket 20 would typically extend the entire length or essentially the entire length of the device 10', although it would be possible to provide a wire jacket 20 only a fraction of the entire length. It would be possible to move the jacket 20 that was provided to any desired location along the length simply by sliding it along the glass fiber outer jacket 12.

Figure 4:
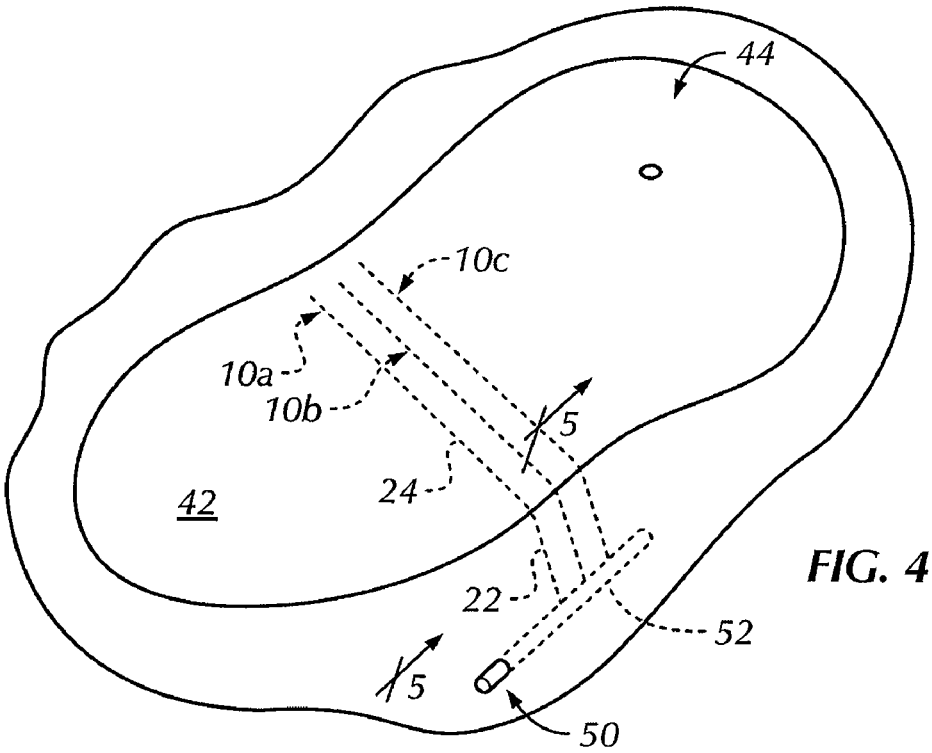
FIG. 4 is a diagrammatic plan view of a golf green showing the positioning of multiple wicking devices of the present invention to collect and transport subsurface water away from the green.
Figure 5:
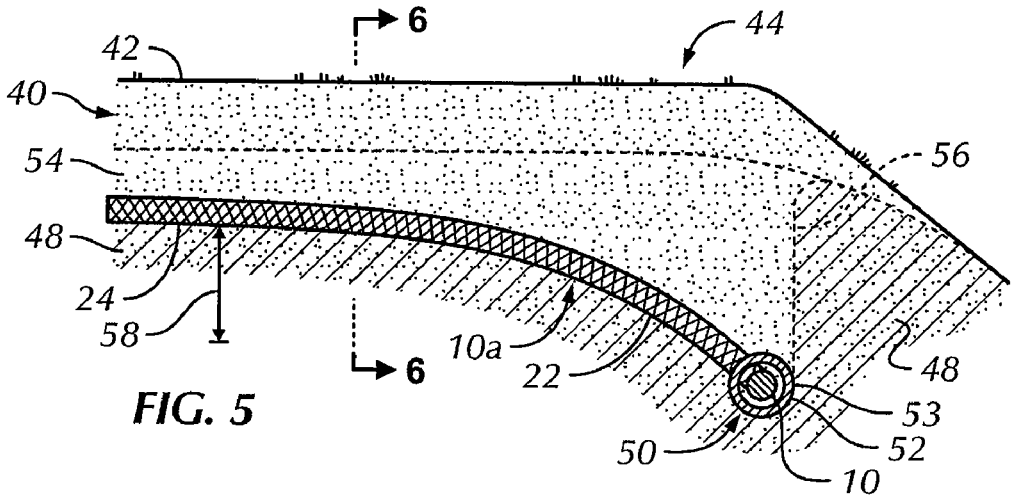
FIG. 5 is a diagrammatic elevation view taken along the lines 5-5 in FIG. 4 of one of the wicking devices of FIG. 4 showing the vertical drop of one end of the wicking device into a transversely extending collection tube.
Figure 6:
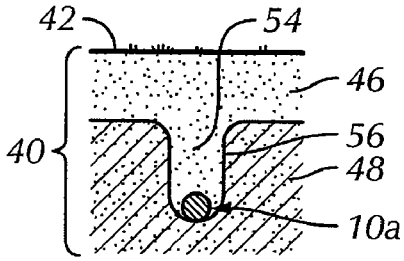
FIG. 6 is an elevation view taken along the lines 6-6 in FIG. 5 showing a trench in which the wicking device is installed beneath the surface of the green.

Wicking devices 10, 10' of the present invention are used in such areas as golf tees, fairways and green, other layered turf soils especially athletic fields, lawns, gardens and other landscapes. Referring to FIGS. 4-6, in use, one or more continuous length wicking devices 10*a*, 10*b*, 10*c* (in phantom) are located in soil 40 beneath the surface 42 of the soil in an area such as a golf green 44 where excess moisture undesirably collects. One or more of the wicking devices 10*a*, 10*b*, 10*c*, are generally routed through the area of excess moisture to draw in and remove the moisture. Suggestedly, adjoining devices 10*a*, 10*b*, etc. are located generally uniformly spaced (about three feet apart on centers), are oriented generally parallel with one another and generally located generally at the same depth with a similar drop of one longitudinal open end, a drain end 22 below the remainder 24 of the respective continuous length for a uniform siphoning action. The open/drain end 22 of each wicking device 10 is located where the collected moisture is to be transferred, usually a drain 50. Drain 50 may be a natural channel or a man made device such as a collector tube 52 also located beneath the surface of the soil 40 into which the one drain end 22 of each length 10*a*, 10*b*, etc. of device 10 is fluidly connected. Where a collector tube 52 is provided, it is suggested that it too contain a wicking device 10 along its length and that the tip of the drain ends 22 of the individual devices 10*a*, 10*b*, etc., be passed through the side wall 53 of tube 52 and into direct contact with the glass fiber outer jacket 20 of the wicking device 10 within the tube 52 to create capillary connections.

Wicking devices 10, 10' are installed generally level (i.e. generally perpendicular to the gravity vector) or preferably sloped slightly down to their drain ends 22 to utilize gravity to assist in removing collected liquid from the remainder 24 of the device. The drain end 22 is preferably provided with enough vertical drop 58 from the lowest part of remainder 24 of the device to create through capillary action of the yarns 15, a water column/siphon suction drainage effect to draw water to the drain end 22. Suggestedly the drain end 22 is provided with a drop of at least nine inches beneath the lowest point of the remainder 24 of the device 10 to create the natural water column/siphon effect. That effect can draw water up to nearly the length of the vertical drop (about seventy percent of the drop or about seven inches in height for nine inches of drop)

from the lowest height of the remainder 24 of the device 10, thereby enabling full drainage of the device 10, even where the device or parts of it are upwardly inclined.

Wicking devices 10, 10' can be installed in various ways. Wicking devices 10, 10' can be used in layered soil applications. Still referring to FIGS. 4-6, push up green 44 has a layer of more porous material 46 like a top dressing atop a base of less porous material 48 such as clay. A cut can be made through the turf on the surface 42 of the soil along the line where the wicking device 10*a*, 10*b*, 10*c* (etc.) is to be installed and the turf separated sufficiently to dig a narrow trench 56 along the line. The trench 56 is dug through the layer 46 of more porous material into the base of less porous material 48. A continuous length wicking device 10 or 10' is located in the bottom of the trench 56 and the trench 56 is refilled with a relatively porous material 54, preferably sand, which permits water to pass down and to be drawn down into the wicking device 10. Where the soil is generally porous down to a level to which moisture control or removal is desired, device(s) 10 can simply be installed in the trench which is back filled with the removed soil. Devices 10 can also be installed before installation of overlying layers, such as beneath a gravel layer before that layer is installed. The glass fiber, non-rusting resilient wire of the preferred construction can be expected to last indefinitely. Devices 10 can also be installed beneath the surface of some soils with special pull through equipment such as vibratory plows (thing-bladed).

In another use, wicking devices 10, 10' of the present invention can be installed in landfills and used to drain liquids out the sides or bottom or even vent gases through the top.

Wicking devices 10 also can be used to prevent water damage to container grown plants from over-watering or residual water that may be trapped by capillary action of the soil at the bottom of the container. In this use, a continuous length of the wicking device 10 is installed around the bottom interior of the container with one end, a drain end, of the wicking device 10 passed through a drain hole or other opening at or near the bottom of the container. It is preferred that an excess length of at least nine inches of the wicking device 10 be allowed to hang generally vertically from the container. The capillary action of the wicking device 10 removes the excess water that has accumulated in the pot, even that normally held at the bottom of the container by capillary action of the potting soil or other growth medium, thereby preventing plant damage from excess water.

Wicking devices can be used for soil measurements. Because of its porosity and permeability, the wicking device 10 can be used with certain instruments like soil column and tension infiltrometers and lysimeters.

U.S. Pat. Nos. 3,578,764 and 4,986,033 and priority Provisional U.S. Patent Application No. 61/088,211 are incorporated by reference herein in their entireties.

It should be understood that this invention is not limited to the particular preferred and other embodiments that have been disclosed and described in detail, but is intended to cover any modifications which are within the scope and spirit of the invention, as defined in the appended claims.

What is claimed is:

1. A wicking device suitable to be buried and operate in soil and comprising in a tubular assembly:

an elongated, porous, tubular, heat resistant, metallic core;

a wicking layer of glass fiber yarns extending generally longitudinally along an outer surface of the metallic core, at least substantially surrounding the metallic core; and an exterior of interwoven glass fiber yarns forming an elongated tubular outer jacket running the length of the device surrounding the wicking layer of glass fiber yarns and the metallic core;

the glass fiber yarns of the wicking layer and the elongated tubular outer jacket being stripped of essentially all organic matter before burial.

2. The wicking device of claim 1 consisting essentially of the elongated, porous, tubular, heat resistant, metallic core and the wicking layer of glass fiber yarns and the exterior of interwoven glass fiber yarns forming the elongated tubular outer jacket.

3. The wicking device of claim 1 wherein the glass fiber yarns of the wicking layer and the tubular outer jacket have been heated sufficiently to remove essentially all organic matter.

4. The wicking device of claim 3 wherein the glass fiber yarns have been heated to at least a temperature of 300° F. before burial.

5. The wicking device of claim 1 further comprising a reinforcement jacket of interwoven wire surrounding the tubular outer jacket of interwoven glass fiber yarns.

6. A method of making the wicking device of claim 1 as an assembly comprising the steps of:

surrounding the metallic core with the wicking layer of glass fiber yarns extending generally longitudinally along the outer surface of the metallic core, at least substantially surrounding the metallic core;

interweaving an outer jacket of glass fiber yarns surrounding the metallic core and the wicking layer of glass fiber yarns to form the tubular assembly; and stripping the tubular assembly of any organic matter.

7. The method of claim 6 wherein the stripping step comprises heating the tubular assembly sufficiently to remove the organic matter.

8. The method of claim 6 wherein the stripping step comprises heating the assembly to a temperature of at least 300° F.

9. A method of using a wicking device comprising the steps of:

locating a first continuous length of the wicking device of claim 1 beneath a surface of soil; and locating one end of the first continuous length of the wicking device below a remainder of the first continuous length of the wicking device to drain the wicking device.

10. The method of claim 9 further comprising the steps of locating a second continuous length of the wicking device beneath the surface of the soil spaced from and oriented generally parallel with the first continuous length of the wicking device with one end of the second continuous length of the wicking device below a remainder of the second continuous length of the wicking device; and connecting the one end of each of the first and second continuous lengths to a common collector tube also located beneath the surface of the soil.

11. The method of claim 9 wherein the step of locating the first continuous length of the wicking device beneath the surface of soil comprises providing enough vertical drop to the one end of the first continuous length to create suction drainage the remainder of the first continuous length of the wicking device.

12. The wicking device of claim 1 wherein the threads for the yarns of the wicking layer are continuous along the length of the device.

13. A wicking device suitable to be buried and operate in soil and comprising in a tubular assembly:

an elongated, porous, tubular, heat resistant, metallic core;

a wicking layer of glass fiber yarns extending generally longitudinally along an outer surface of the metallic core, at least substantially surrounding the metallic core; and an exterior of interwoven glass fiber yarns forming an elongated tubular outer jacket running the length of the device surrounding the wicking layer of glass fiber yarns and the metallic core;

wherein the glass fiber yarns of the wicking layer and the tubular outer jacket have been stripped of any hydrophobic coating before burial.

14. The wicking device of claim 13 having been heated before use to strip essentially any hydrophobic coating from the glass fiber yarns of the wicking layer and the outer jacket.

15. A wicking device suitable to be buried and operate in soil and comprising in a tubular assembly:

an elongated, porous, tubular, heat resistant, metallic core;

a wicking layer of glass fiber yarns extending generally longitudinally along an outer surface of the metallic core, at least substantially surrounding the metallic core; and an exterior of interwoven glass fiber yarns forming an elongated tubular outer jacket running the length of the device surrounding the wicking layer of glass fiber yarns and the metallic core;

wherein the wicking device has been heated to a temperature of at least 300° F. before burial.

16. The wicking device of claim 15 having been heated sufficiently long at 300° F. to strip the glass fiber yarns of the wicking layer and the outer jacket of essentially all organic matter.

17. A method of making a wicking device comprising the steps of:

providing an elongated, porous, tubular, heat resistant, metallic core;

providing a wicking layer of glass fiber yarns extending generally longitudinally along an outer surface of the metallic core, at least essentially surrounding the metallic core along essentially the length of the device; and interweaving glass fiber yarns to form an elongated tubular outer jacket running the length of the device surrounding the wicking layer of glass fiber yarns and the metallic core; and stripping the assembled core, wicking layer and tubular outer jacket of essentially all organic material present in the assembled core, wicking layer and tubular outer jacket.

18. The method of making the wicking device of claim 17 wherein the stripping step comprising the step of heating the assembled core, wicking layer and tubular outer jacket to an internal temperature of at least 300° F.

* * * * *